US007758749B2

(12) United States Patent
Cook et al.

(10) Patent No.: US 7,758,749 B2
(45) Date of Patent: Jul. 20, 2010

(54) DRAINAGE FILTRATION SYSTEM FOR SYNTHETIC TURF FIELD

(75) Inventors: Charles C. Cook, Rochester, MI (US); James H. Cassel, Holly, MI (US)

(73) Assignee: General Sports Venue LLC, Rochester, MI (US)

( * ) Notice: Subject to any disclaimer, the term of this patent is extended or adjusted under 35 U.S.C. 154(b) by 0 days.

(21) Appl. No.: 11/766,338

(22) Filed: Jun. 21, 2007

(65) Prior Publication Data

US 2008/0017563 A1 Jan. 24, 2008

Related U.S. Application Data

(60) Provisional application No. 60/805,379, filed on Jun. 21, 2006.

(51) Int. Cl.
*B01D 35/02* (2006.01)

(52) U.S. Cl. ..... 210/170.03; 405/43; 405/45; 472/92

(58) Field of Classification Search ..... 210/170.01, 210/170.03, 170.07, 170.08; 405/36, 43, 405/45, 49; 472/92
See application file for complete search history.

(56) References Cited

U.S. PATENT DOCUMENTS 3,995,079 A 11/1976 Haas, Jr.
4,023,506 A * 5/1977 Robey ..... 472/92
4,389,435 A 6/1983 Haas, Jr.
4,679,963 A * 7/1987 Heath ..... 405/36
4,913,596 A * 4/1990 Lambert, III ..... 405/43
5,064,308 A * 11/1991 Almond et al. ..... 405/43
5,752,784 A * 5/1998 Motz et al. ..... 405/43
5,803,662 A * 9/1998 Gunter ..... 472/92
5,976,645 A 11/1999 Daluise et al.
6,338,885 B1 1/2002 Prevost
7,128,497 B2 * 10/2006 Daluise ..... 405/43
7,147,401 B2 * 12/2006 Wickens ..... 405/45
2003/0092531 A1 * 5/2003 Daluise ..... 472/92
2003/0175079 A1 * 9/2003 Happel et al. ..... 405/43
2005/0129906 A1 * 6/2005 Knox ..... 428/95
2006/0029472 A1 * 2/2006 Blackwood et al. ..... 405/36

* cited by examiner

*Primary Examiner*—Christopher Upton
(74) *Attorney, Agent, or Firm*—Dickinson Wright PLLC

(57) ABSTRACT

A drainage system for a synthetic sports field is disclosed that substantially prevents the leeching of specific contaminants from surface runoff water from entering into water tables or sewer systems associated with the drainage of the synthetic sports field. The drainage system includes a containment system and filtration system located beneath the synthetic sports field for directing rainwater through a series of drains and filters prior to being exposed to either the sewer system or water table. In this way, environmental concerns associated with the drainage of synthetic sports fields is alleviated.

13 Claims, 2 Drawing Sheets

DRAINAGE FILTRATION SYSTEM FOR SYNTHETIC TURF FIELD

CROSS REFERENCE TO RELATED APPLICATION

The present invention claims priority from U.S. Provisional Application Ser. No. 60/805,379 filed Jun. 21, 2006, and entitled "Drainage Filtration System for Synthetic Turf Field".

TECHNICAL FIELD AND INDUSTRIAL APPLICABILITY OF THE INVENTION

The present invention relates generally to synthetic turf fields and more specifically to a drainage filtration system for synthetic turf fields.

BACKGROUND OF THE INVENTION

Synthetic grass sports surfaces are well known. These surfaces are becoming increasingly popular as replacements for natural grass surfaces in stadiums, playgrounds, golf driving ranges, and a variety of other facilities. The synthetic grass surfaces stand up to wear much better than the natural grass surfaces, do not require as much maintenance, and can be used in partially or fully enclosed stadiums where natural grass cannot typically be grown.

Most synthetic grass surfaces comprise rows of strips or ribbons of synthetic grass-like material, extending vertically from a backing mat with particulate material infill ("infill") in between the ribbons on the mat. One or more layers of aggregate material are introduced between the backing mat and on top of a smoothed and compacted subgrade. The grass surfaces are usually sloped, and typically utilize drainage systems, to facilitate drainage resulting from rainstorms or other events.

The infill usually comprises sand, as shown by way of example in U.S. Pat. No. 3,995,079 and U.S. Pat. No. 4,389,435, both to Haas, Jr. More recently, the particulate matter can also comprise a mixture of sand and other materials, including rubber infill, as shown, for example, in U.S. Pat. No. 6,338,885 to Prevost, or entire rubber infill systems, such as those disclosed in U.S. Pat. No. 5,976,645 to Daluise et al. In these systems, the particulate matter provides resiliency to the synthetic grass surfaces and adds weight to hold down the backing material, thus helping to ensure that the strips of synthetic grass do not move or shift during play.

The use of infill in synthetic turf fields, especially infill that includes resilient materials such as rubber, has raised environmental concerns as to the effect of such materials, or chemical components of such materials, leeching into water tables for turf fields utilizing the ground for drainage. For turf fields having drainage systems incorporated in their design that substantially prevent water runoff from reaching the water tables, there are still environmental concerns with allowing these materials to enter storm or sewer drains.

SUMMARY OF THE INVENTION

The present invention is directed to a new and improved drainage filtration system for use with a synthetic turf field that is designed to substantially remove contaminants, including contaminants from infill, from surface runoff water prior to the runoff water reaching either the water tables or sewer systems. The system includes a liner system designed to direct all surface runoff water to a series of drains located beneath the synthetic turf field. In this way, surface runoff water is prevented from reaching any water tables located in close proximity to the subgrade beneath the synthetic turf field. In addition, the drains include a filtration system that removes particulate and chemical contaminants from the surface runoff water prior to the surface runoff water entering either a storm or sewer drain.

In one preferred embodiment of the present invention, the drainage filtration system includes an impermeable liner system that is placed between the synthetic turf material and the underlying subgrade. The liner system and lateral drainage system are remotely coupled to a perimeter draining system, which in turn is remotely coupled to the storm or sewer system. The liner system and lateral drainage system are configured to remove water that drains through overlying turf and direct the water to the perimeter drainage system. The perimeter draining system includes a filtration system including one or more filters that are located near the outlet to the sewer or storm drain. Each filter is designed to remove contaminants from the surface runoff water as the water moves through the filter towards the sewer or storm drain on the basis of size exclusion. The filter may also be treated with chemical or other materials designed to trap other chemical contaminants that may leech the contaminants into the surface runoff water that are too small to be trapped by the pores of the filters.

The filters used in the filtration system may be permanent filters or replaceable filters that are replaced at regular predetermined intervals. Preferred permanent filtration systems are ones that utilize the so-called "hepa" filter system or systems based on reverse osmosis or similar technology to remove particulate matter material.

In yet another preferred embodiment of the present invention, the lateral drains may be removed from the system. In this embodiment, the subgrade beneath the impermeable liner is sculpted to at least a +/−2% slope from the middle of the field downward to the perimeter drainage system, thereby facilitating sheet drainage of the surface runoff water to the perimeter drainage system without the need for the lateral drains.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
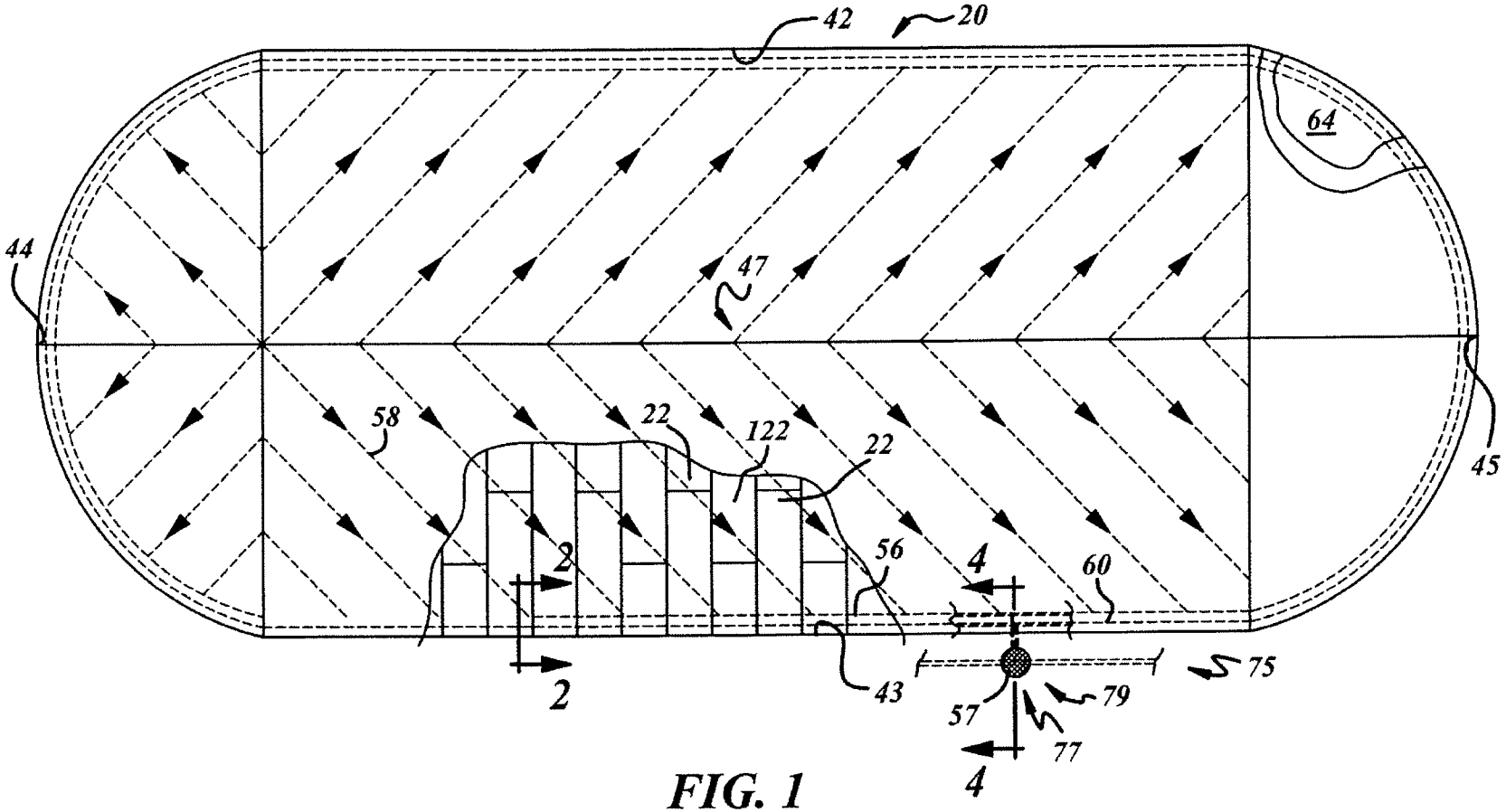
FIG. 1 is a top plan view of a sports field including a drainage filtration system according to one preferred embodiment of the present invention.

The present invention describes a drainage system 75 for a synthetic turf sports playing surface 20, here a football field, according to preferred embodiments of the present invention. The playing surface 20 is formed having one or more strips 22 of a synthetic turf grass surface 24 on either side of a central strip 122. The strips 22, 122 are placed on top of a substrate 64 in rows across the field such that the respective edges 22A of adjacent strips 22 are substantially lined up and a cover the substrate 64 along a boundary defined by a first lengthwise side 44, a second lengthwise side 45, a first widthwise end 43 and a second widthwise end 44. Of course the boundary is defined by the ultimate end use and is not limited by the particular configuration described herein.

Figure 2:
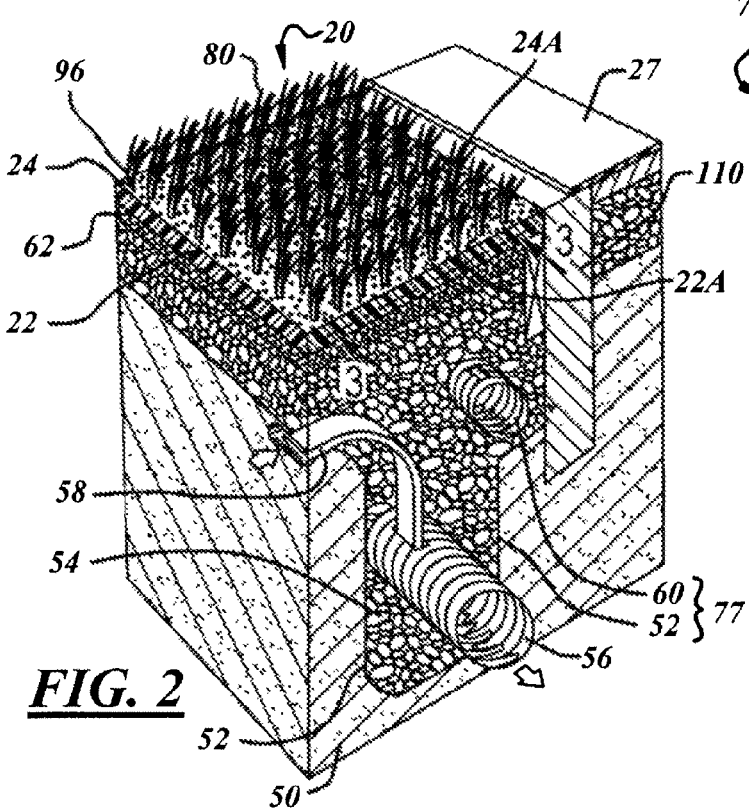
FIG. 2 is a section view of a portion of the sports field of FIG. 1 taken along line 2-2.
Figure 3:
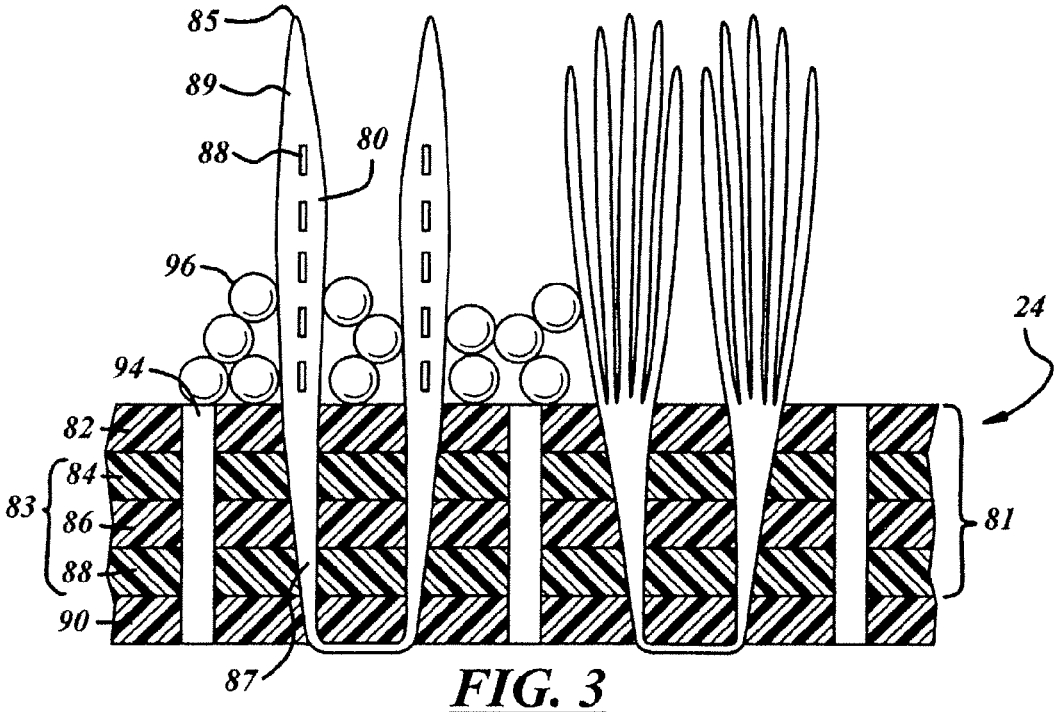
FIG. 3 is a section view of a portion of the FIG. 2 taken along line 3-3.

As best shown in FIGS. 2 and 3, the strips 22 of the synthetic grass material 24 are placed on top of the substrate 64 in rows across the field such that the respective edges of adjacent strips 22 are substantially aligned. The synthetic grass surface 24 has a plurality of strands 80 of synthetic yarn tufted (stitched) through a multi-layer backing material 81 in rows separated by a first distance or gauge. The backing layer 81 preferably is formed from one or more layers (here shown as three layers 84, 86, 88) of a backing material. A secondary coating 90 is applied to the bottommost layer 88 to seal the strands 80 to the backing layer 81 and to add a layer of dimensional stability to the backing 81.

The strands 80, when applied to the backing material 81, will be preferably configured such that the tufted portion 87 of the strand is aligned in rows and further such that the uppermost ends 85 of the strands lay a particular way on the backing material 81. In other words, the tufting process is performed such that the uppermost ends 85 of the strands 80 will naturally fall substantially in the same direction on top of the backing material 81. Further, the strands 80 preferably include fibrils 88 in its upper portion 89.

A layer of infill 96 is introduced onto the backing material 81 to a depth less than that of the uppermost portion 85 of the strands 80 extending upward from the backing material 81. One non-limiting example of the synthetic yarn strands 80, backing material 81, secondary coating 90, and infill 96 of the playing surface 20 that may be utilized in the present invention, as well as the method for installing the playing surface, is described in U.S. patent application Ser. No. 11/144,587 to Cook et al., which is herein incorporated by reference. A series of holes 94 are preferably punched through the backing layer 81 and secondary coating 90 at predetermined locations to promote drainage to the underlying substrate 64 and drainage system 75.

As best shown in FIG. 2, the substrate 64 is formed having a water impermeable fabric 52 laid onto a compacted and substantially leveled subgrade 50, or subsoil. The impermeable fabric 52 substantially prevents rainwater from entering the subgrade 50.

The substrate 64 also includes a coarse aggregate draining layer 54 having a pair of perforated drains 56 located on either widthwise end 42, 43 of the field is placed onto the impermeable fabric 52. Preferably, the coarse aggregate draining layer 54 is a type 21aa, ¾-inch washed stone having 6 alpha gradation. However, other materials that may be used include certain kinds of clay or topsoil meeting a 95 percent proctor rate requirement. For the purposes of the present invention, a 95 percent proctor is the equivalent of a 95 percent maximum dry density.

A plurality of drain tiles 58 are optionally installed approximately every 20-30 feet, and more preferably every 24 feet, beneath the length of the strip 22 extending from widthwise end 42 to widthwise end 43 of the field 20. The drain tiles 58 are coupled to at least one of the perforated drains 56. As best shown in FIG. 1, the drain tiles 58 are preferably laid in a herringbone pattern to cover more surface area beneath the overlying strips 22, 122. In this way, water draining from the overlying strips 22 can be removed quickly, therein substantially reducing the appearance of puddles on the surface of the strips 22 as a result of inclement weather. The drain 56 and drain tiles 58 are preferably formed of a hard plastic material such as polyvinyl chloride ("PVC").

Of course, as one of ordinary skill appreciates, the location of the drains 56 and drain tiles 58 may be placed in any other configuration that allows adequate draining of the surface of the field 20 at a rate desired. For example, the drains 56 may alternatively run along the sides 44, 45 of the field, with the coupled drain tiles 58 running perpendicular to the strips 22 and still fall within the spirit of the present invention.

In addition, a secondary perforated drain 60 is optionally and preferably laid parallel to drain 56 along the ends 42, 43 and closer to a visible surface of the playing surface 20 that is not coupled to the respective drain tiles 58. The secondary perforated drain 60 catches water that drains along the surface of the strips 22 as it drains due to the overall crowning of the overlying strips 22. The drains 56, 60 are preferably fluidically coupled to a perimeter drain 57 to facilitate water removal.

The rest of the coarse aggregate draining layer 54 is introduced over the drains 56, 60 and the drain tile 58 to secure the positioning of the drains 56 and the tile 58. The thickness of the aggregate draining layer 54 is preferably about 6 to 8 inches in the center 47 of the field 20, but may be thicker along the ends 42, 43 and sides 44, 45 to accommodate the drains 56, 60 and facilitate water removal. A layer of fine aggregate draining layer 62 is then introduced over the coarse aggregate draining layer 54. Preferably, the fine aggregate layer 62 is a ⅜ inch washed stone aggregate material. Obviously, the fine aggregate layer may take on a variety of different materials. The fine aggregate layer 62 is applied such that the field 20 slopes ½ percent from the center 47 of the fields to the ends 42, 43 in one embodiment. This is the equivalent of about a 6 to 12 inch height difference from the center 47 to each respective widthwise end 42, 43 on a standard football field. The layer 62 is then rolled using machine rollers to ensure a 95 percent proctor. In addition, the fine aggregate layer 62 is compaction tested to ensure compliance with the field specifications.

Figure 4:
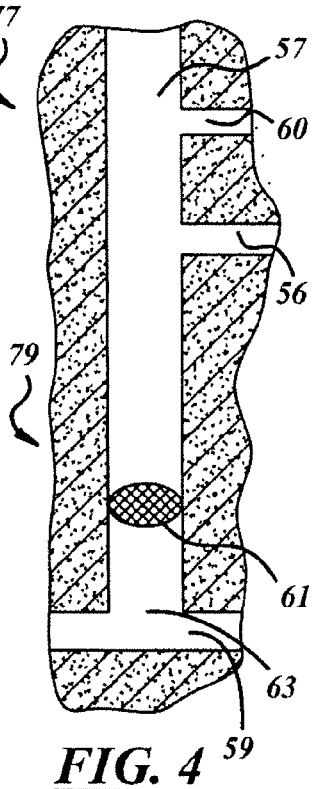
FIG. 4 is a bottom section view of a portion of the drainage filtration system of FIG. 1 defined within oval 4.

As best shown in FIGS. 1 and 4, these drains 56, 60 are coupled to a perimeter drain 57 located preferably outside the boundaries of the playing surface 20, which in turn is preferably coupled to a sewer system 59. However, the perimeter drain 57 may simply end into a drainage ditch or other water detention area. The perimeter drain 57 is typically an 8 to 12 inch PVC pipe. The liner 52, drain tiles 58, drains 56, 60 and perimeter drain 57 together define a containment system 77 designed to gather surface runoff water draining through the playing surface 20 during rainstorms or other events and prevent the water from entering the subgrade 50 and any water tables or environmental areas located beneath or near the playing surface 20.

A filter 61 or filters are coupled within a portion of the perimeter drain 57 near its outlet 63 to either the sewer system 59 or to the existing natural location or controlled wetland region. Preferably, the filters 61 are located about 6-8 inches from the outlet 63 to the sewer system 59.

The filter 61 is sized with pores designed to prevent the flow of any contaminant matter contained in the runoff water draining from the field 20 from entering the sewer system 59 based on size exclusion. This contaminant matter may include any portion of the synthetic turf playing surface 20 or substrate 64, including but not limited to portions of the infill 96, yarn strands 80, backing material 81, aggregate layers 54, 62, or any other material entering the perimeter drain 57 with surface runoff water draining from the playing surface 20. The filter 61 may also be treated with chemical or other materials designed to trap other chemical contaminants that may leech from the particulate matter during rainstorms. The filters 61 therefore constitute a filtration system 79, that together with the containment system 77, define the drainage filtration system 75.

It is contemplated that the filters 61 of the present invention are sized with pores and/or coated with chemicals designed to remove a wide variety of contaminants including, but not limited to, rubber, lead, cadmium, chromium, zinc, mercury, and tin. The filters 61 are also preferably designed to remove dissolved organic carbon ("DOC") and extractable organic halogens ("EOX") from soil that may be found in surface runoff.

The filter 61 is preferably a replaceable filter or series of filters that is secured within a portion of the perimeter drain 61 and replaced at predetermined intervals determined by numerous factors, including the size (thickness and pore size) of the filters 61 or other environmental factors specific to the area of installation. The filters 61 are rated to maintain a flow rate calculated using data from a 50-year storm or similar industry standard.

Alternatively, a permanent filtration system may be introduced within the main perimeter drain 59 that is not replaced at predetermined intervals, but may be cleaned during intervals wherein rainfall is not being evacuated to the sewer system 59. As with the replaceable filters, the permanent filtration system is rated to maintain a flow rate calculated using data from a 50-year storm or similar industry standard. One example of a permanent filtration system that is preferably utilized in the present invention is the so-called "hepa" filter system. Other permanent filtration systems contemplated include systems that utilize reverse osmosis technology to remove particulate matter material from escaping to the sewer lines.

In yet another preferred embodiment of the present invention, the lateral drains 56, 60 and drain tiles 58 may be removed from the drainage system 75. In this embodiment, the subgrade 50 beneath the impermeable liner 52 is sculpted to at least a +/−2% slope from the middle 47 of the field downward to the perimeter drains 57, thereby facilitating sheet drainage to the perimeter drains 57 directly.

While the invention has been described in terms of preferred embodiments, it will be understood, of course, that the invention is not limited thereto since modifications may be made by those skilled in the art, particularly in light of the foregoing teachings.

What is claimed is:

1. A synthetic turf sports field comprising:

(a) a synthetic turf playing surface disposed on a subgrade, said synthetic turf playing surface including an infill;

(b) a substrate disposed between said synthetic turf playing surface and said subgrade, said substrate intended to facilitate draining and including a fine aggregate layer disposed directly underneath said synthetic turf playing surface and a coarse aggregate layer disposed beneath said fine aggregate layer; and (c) a drainage system coupled within said substrate and fluidically coupled to said synthetic turf playing surface for removing runoff fluid from said synthetic turf playing surface and preventing runoff fluid from draining to a fluid water table, said drainage system comprising:

at least one perforated drain coupled within said substrate, a plurality of drain tiles contained within said substrate beneath said synthetic turf playing surface, each of said plurality of drain tiles fluidically coupled to at least one of said at least one perforated drain;

a perimeter drain fluidically coupled to said at least one perforated drain, said perimeter drain fluidically coupled to a sewer system at an outlet end, said perimeter drain located adjacent a perimeter of said synthetic turf playing surface; and an impermeable fabric disposed beneath said at least one perforated drain, said plurality of drain tiles, and said perimeter drain to direct water thereto, said impermeable fabric disposed within said substrate and above said subgrade to prevent said runoff water from contacting said water table, a filter coupled within said outlet end of said perimeter drain, said filter substantially preventing contaminant material contained in said runoff water from entering said sewer system.

2. The synthetic sports field of claim 1, wherein said drainage system further comprises a secondary perforated drain fluidically coupled to said perimeter drain.

3. The synthetic sports field of claim 1, wherein said filter is chemically treated to trap chemical contaminants in said runoff water.

4. The synthetic sports field of claim 1, wherein said filter is treated to trap dissolved organic carbon in said runoff water.

5. The synthetic sports field of claim 1, wherein said filter is treated to trap extractable organic halogens in said runoff water.

6. The synthetic sports field of claim 1, wherein said filter comprises a plurality of filters, each of said filters separated by a predetermined distance interval within said perimeter drain.

7. The synthetic sports field of claim 1, wherein said filter comprises a replaceable filter.

8. The synthetic sports field of claim 1, wherein said filter is rated to maintain a flow rate calculated using data from a 50-year storm industry standard.

9. The synthetic sports field of claim 8, wherein said filter comprises a hepa filtration system.

10. The synthetic sports field of claim 8, wherein said filter comprises a reverse osmosis filtration system.

11. The synthetic sports field of claim 1, wherein said filter comprises cleanable permanent filter.

12. The synthetic sports field of claim 1, wherein said drain tiles are laid in a herringbone pattern with a coarse aggregate layer beneath said synthetic turf playing surface.

13. The synthetic sports field of claim 1, wherein said perimeter drain is not located beneath said synthetic turf playing surface.

* * * * *